US007241178B2

(12) United States Patent
Schaffner

(10) Patent No.: US 7,241,178 B2
(45) Date of Patent: Jul. 10, 2007

(54) HIGH VOLTAGE PROOF ELECTRICAL PLUG AND SOCKET CONNECTION

(75) Inventor: Norbert Schaffner, Bassecourt (CH)

(73) Assignee: Techpointe S.A. (CH)

( * ) Notice: Subject to any disclaimer, the term of this patent is extended or adjusted under 35 U.S.C. 154(b) by 0 days.

(21) Appl. No.: 11/376,395

(22) Filed: Mar. 15, 2006

(65) Prior Publication Data

US 2006/0211308 A1 Sep. 21, 2006

(30) Foreign Application Priority Data

Mar. 16, 2005 (DE) ..... 20 2005 004 231 U

(51) Int. Cl.
*H01R 24/00* (2006.01)

(52) U.S. Cl. ..... 439/660; 439/181

(58) Field of Classification Search ..... 439/660, 439/682, 181, 273, 278, 281, 732
See application file for complete search history.

(56) References Cited

U.S. PATENT DOCUMENTS 3,124,405 A * 3/1964 Massa ..... 439/282
3,160,460 A * 12/1964 Wyzenbeek ..... 439/685
3,266,009 A * 8/1966 Jensen et al. ..... 439/275
3,324,449 A * 6/1967 McLoad ..... 439/201
3,601,761 A * 8/1971 Harris ..... 439/275
3,654,590 A * 4/1972 Brown ..... 439/185
4,797,117 A * 1/1989 Ayers ..... 439/200
6,062,905 A * 5/2000 Sampa et al. ..... 439/587
6,273,754 B1 * 8/2001 Bunch et al. ..... 439/587
6,443,773 B1 * 9/2002 Korsunsky et al. ..... 439/660
6,632,104 B2 * 10/2003 Quadir ..... 439/587
6,699,078 B2 * 3/2004 Quadir ..... 439/693
2004/0097139 A1 * 5/2004 Takada ..... 439/733.1

FOREIGN PATENT DOCUMENTS

DE 195 28 678 C1 1/1997
DE 44 19 023 C2 2/1998

* cited by examiner

*Primary Examiner*—James R. Harvey
*Assistant Examiner*—Travis Chambers
(74) *Attorney, Agent, or Firm*—St. Onge Steward Johnston & Reens LLC

(57) ABSTRACT

An electrical plug-and-socket connection with a male plug that includes at least two contact pins, which contact pins are linked to a base body of a plug-in aperture for a plug-in section of a female plug, and after connection of the male and female plugs are inserted into contact apertures of the front side of the plug-in section, and where the section of every contact pin that connects immediately to the base body of the plug-in aperture is circumferentially insulated by a collar that is connected by being of identical material with the base body. To increase the high-voltage-proof quality in plug-and-socket connections with contact pins placed close together, the invention proposes that the rounded conical-shaped mantle surface of the collar when the plug parts are connected is in uninterrupted circumferential contact with a section of the walling of the contact aperture, at least in some areas.

14 Claims, 3 Drawing Sheets

HIGH VOLTAGE PROOF ELECTRICAL PLUG AND SOCKET CONNECTION

CROSS-REFERENCE TO RELATED APPLICATIONS

The present application claims priority of German patent application No. 20 2005 004231.5 filed on Mar. 16, 2005, the content of which is incorporated herein by reference.

FIELD OF THE INVENTION

The invention relates to an electrical plug-and-socket connection with a male plug that includes at least two contact pins, which contact pins are linked to a base body of a plug-in aperture for a plug-in section of a female plug, and after connection of the male and female plugs, are inserted into contact apertures of the front side of the plug-in section, and where the section of every contact pin that connects immediately to the base body of the plug-in aperture is circumferentially insulated by a collar that is connected by being of identical material with the base body.

BACKGROUND OF THE INVENTION

The male plug of a plug-and-socket connection of this type is described in DE 195 28 678 C1. From the base body of a plastic core of the male plug, which is surrounded by a sleeve, there extends a number of contact pins. In the area close to the base body, cylindrical-shaped collars are shaped onto these contact pins which are made of a metal in equal strength over the entire relevant axial area.

From DE 44 19 023 C2, a similar plug of a plug-and-socket connection is know, in which the electrical conducting section of a contact pin in the area close to the base body is constructed with a declining diameter. This declining-diameter section is filled with plastic of the core material of the plug, so that the contact pin has an essentially uniform diameter despite the reduced-cross-section zone of its core. In another embodiment, this publication describes how the base body of the plug-in aperture rises to a truncated cone or frustum shaped socket around a contact pin.

On the basis of the state of the art mentioned at the outset, it is the aim of the invention to increase the high-voltage insulation in plug-and-socket connections with contact pins that are in close proximity to one another.

SUMMARY OF THE INVENTION

This aim is fulfilled by the invention as indicated in the Patent Claims, where every claim represents a separate solution of the aim and each claim can be combined with any other claim.

In accordance with an exemplary embodiment of the present invention, the mantle surface of the collar has a truncated conical or frustum shape. This is an acute-angle frustum shape. With the male and female plugs connected, a section of the walling of the contact aperture of the female plug is to enter into uninterrupted circumferential contact with the mantle surface of the sleeve. The collar in this case can surround a section of the metallic core of the contact pin that has a reduced cross-section. The mantle surface connects to the mantle surface of the electrically conducting section of the contact pin without irregularity, that is, only causing a change of direction. The uninterrupted contact zone, which extends circularly around the collar, is formed by the outer surface edge of the plug-in aperture, according to a preferred embodiment of the invention. This aperture provides insulation and is contiguous with the mantle surface of the collar. As a result, steps are taken to avoid a spark discharge between two closely situated contacts. The effective spark path is extended because the axial height of the collars corresponds to at least half the distance between two neighboring sleeves A preferred elaboration of the invention foresees that the male and female plugs are axially power-actuated. This can be achieved by appropriate devices known in the art. Thus it is possible for the female and male plugs to be screwed together. This can be done, for instance, by means of a coupling ring, which is linked to the female plug portion and can be screwed onto an outer thread on the male plug portion. Other devices can also be produced in order to press the two plug portions to one another. For instance, a spring collar can be used. An essential result of the power actuation of the male and female plugs when connected is an insulating power-actuated juxtaposition of the contact surface of the plug-in aperture on a section of the collar. As a result the entire electrically conducting section of the contact pin in its connected state is encapsulated circumferentially by an insulating material. The core of the female plug, which constitutes the plug-in apertures, is made of plastic. Inside the plug-in aperture are contact elements of the female plug, which enter into contact with the electrically conducting section of the contact pin. The contact elements of the female plug also lie within this encapsulated area. They too are insulated in appropriate manner from one another against high voltage. The core of the male plug, which also constitutes the collars, is also plastic. In a preferred embodiment the angle of aperture of the conical collars is less than 10 degrees. The diameter of the contact pin is preferably about 1 mm. This is the same diameter as that of the crest of the collar. The base of the collar has a diameter of about 1.2 mm. The aperture distance of the plug-in aperture is in a range between 1 and 1.22 mm, preferably 1.1 mm. The diameter of the plug-in aperture for the plug-in section of the female plug is preferably approximately between 5.5 and 6 mm. Two of the four contact pins extend out of the base body, with a corresponding diameter, of the plug-in aperture. The axial length of the collar is preferably about 1 m.

One embodiment of the invention is described in the following with reference to appended drawings.

BRIEF DESCRIPTION OF THE DRAWINGS

FIG. 2 shows an aerial view of the male plug of the plug-in connection with the female plug not plugged in.

DETAILED DESCRIPTION OF THE INVENTION

Figure 1:
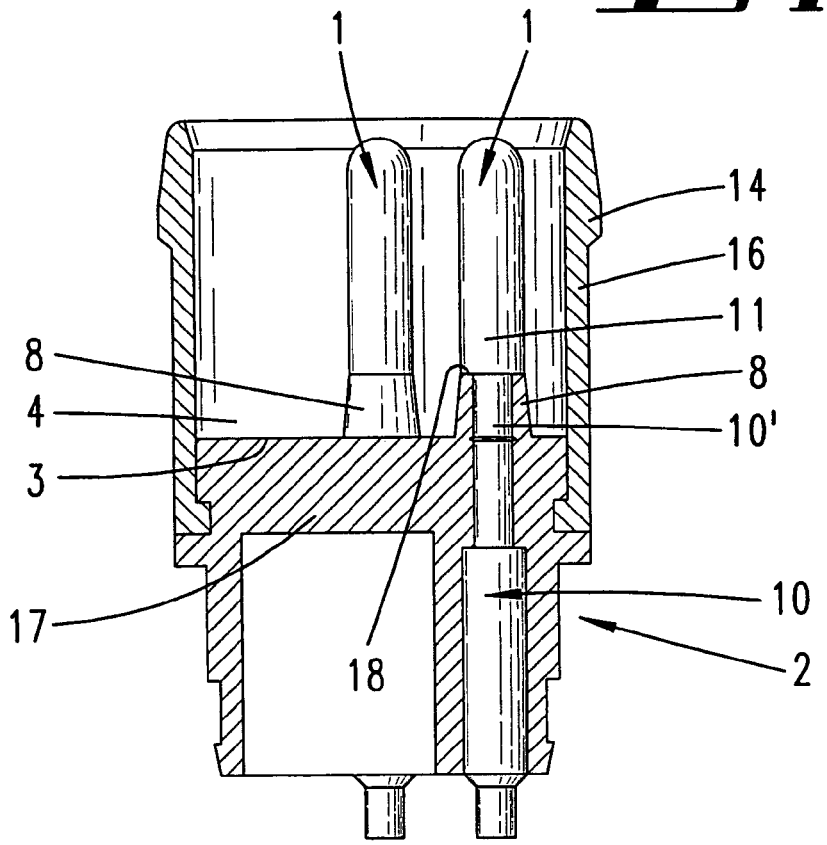
FIG. 1 shows a cutaway depiction along the trim line I-I as seen in FIG. 2.
Figure 2:
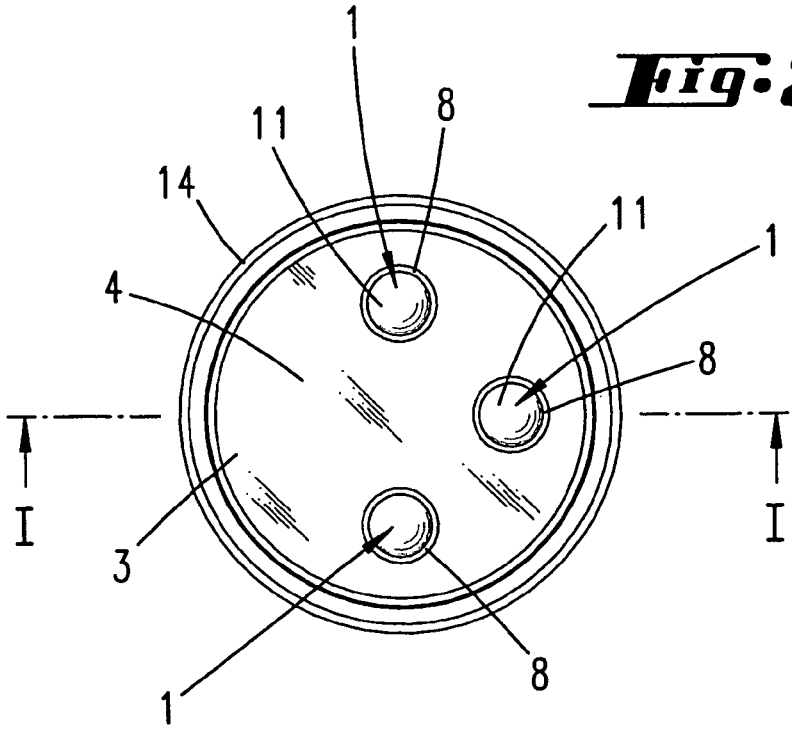

The base body 3 of the plug-in aperture 4 is configured by the core 17. In the embodiment a total of three contact pins 1 arise from the base body 3. The contact pins 1 each possess a metallic core 10, which is connected on the leads (not illustrated) of a cable. The connection points of the individual cables are insulated against high voltage.

The contact pins 1 are inserted into contact apertures 7 of the female plug 6. The outlets of the contact apertures 7 lie in the front side 5' of the plug-in section 5. Inside the contact apertures 7 there are only contact elements of the female plug 6 (indicated by number 19), which enter into electrical contact with the metallic and thus electrically conducting section 1 of the contact pin 1 when the plugs are connected. The contact elements 19 are connected with non-illustrated leads of the cable lines. The electrical contact is entirely encapsulated by plastic.

Figure 3:
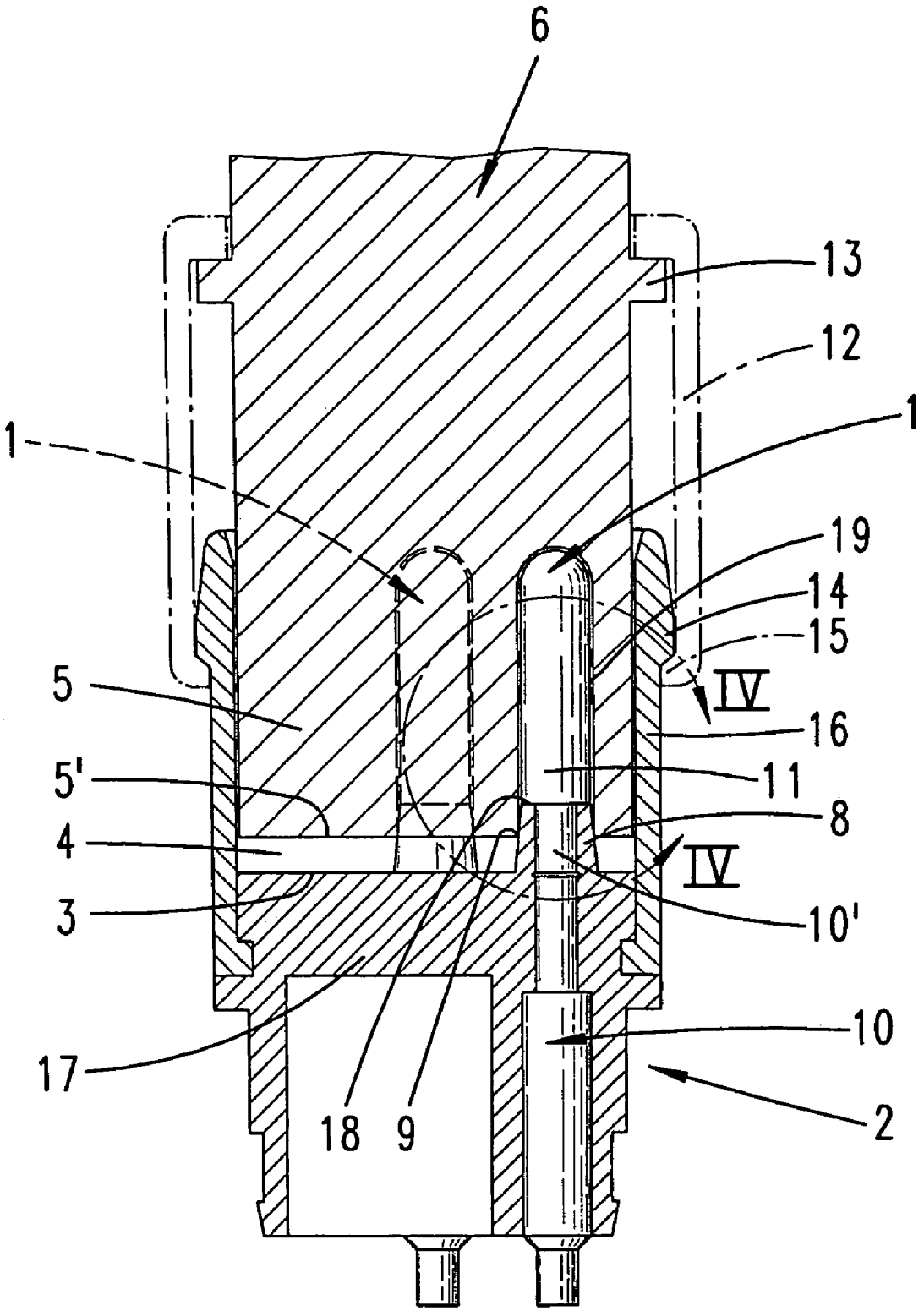
FIG. 3 is a depiction as in FIG. 1 with the female plug inserted.
Figure 4:
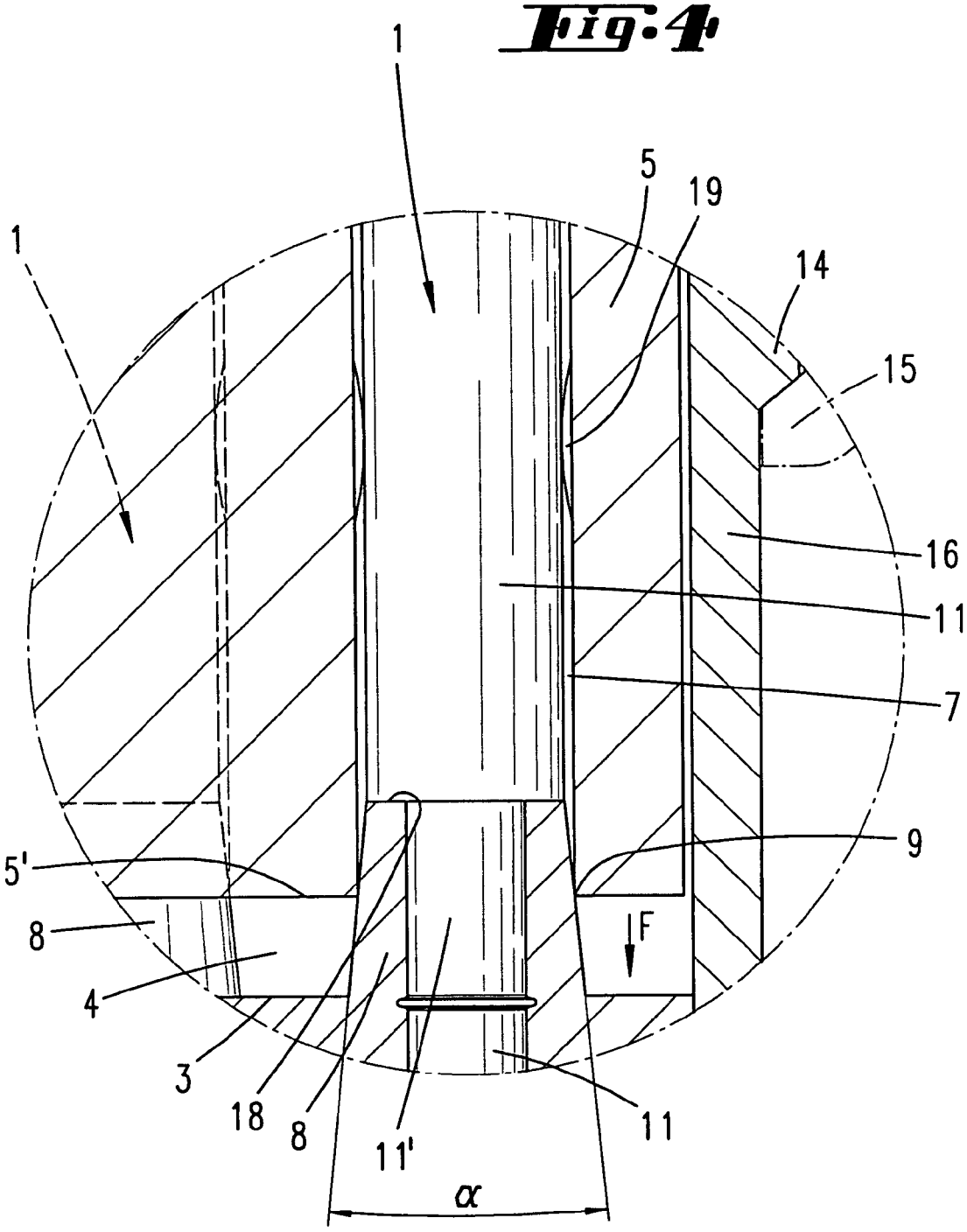
FIG. 4 shows an enlarged detail of the area labeled IV-IV in FIG. 3.

Reference number 12 indicates devices that permanently exert axial force between the female plug 6 and the male plug 2. These devices 12 can be a coupling ring, a spring connection, or a screw-in device. In FIG. 3 the device is a sleeve which is supported on a circular step and engages with an overlapping 15 by means of a thickening 14 of the sleeve 16. The contact pins 1 have a diameter of about 1 mm and a distance that lies between 1 and 2 mm. Two contact pins 1 diametrically opposite one another can even be at a distance of more than 3 mm from one another.

The metallic core 10 of the contact pin 1 has an area 10' with reduced cross-section. This area, as well as the other portion of the metallic core 10, has a circular base area. The metallic core 10 is configured entirely as a rotating body. The section 10' with reduced cross-section extends about 1 mm beyond the base body 3 of the plug-in aperture 4 and is completely surrounded by a collar 8 of plastic. This is the same plastic material that also forms the core of the male plug 17. On the truncated point of the collar 8, its diameter corresponds to the diameter of the electrically conducting section 11, that is, in the present case about 1 mm. The base of the truncated collar 8, which has an axial height of about 1 mm, has a diameter of about 1.2 mm, so that the angle of aperture is less than 15 degrees and preferably less than 10 degrees.

The diameter of the contact aperture 7 of the female plug 6 is adjusted to the diameter of the collar 8 in such a way that it is greater than the peak diameter of the truncated cone 8 and smaller than the base diameter of the truncated cone 8. As a result of this diameter, it is guaranteed that the edge 9 of the outlet of the contact aperture 7 can be brought into uninterrupted circumferential contact with the collar 8. Because the material of collar 8 and plug-in section 5 can be elastically reshaped, the contact surface between the outlet of the contact aperture and the collar 8 will increase as the axial power actuation increases. The resulting circular insulation zone ensures that the electrically conducting section 11 of the contact pin 1, which is contained entirely in the contact aperture 7 of the female plug 6, is entirely encapsulated by an insulating material. Consequently, spark discharges between neighboring contact pins 1 are prevented up to voltages of 10,000 volts. At the same time, the male plug becomes watertight. In the manufacture of the male plug 2 and female plug 6, care is taken to ensure that the contact points 1 are in coaxial position with respect to the contact apertures 7 of the related female plug 6. In a variant (not illustrated) of the invention, the outlet of the contact aperture 7 is slightly conical in shape.

The counter-contacts 19 of the female plug 6 extend out of the plastic surrounding of the plug-in section 5 into the contact aperture 7. The counter-contacts 19 are injected in the plastic body that forms the plug-in section 5 in such a way that no air gap remains.

All revealed characteristics are, in themselves, integral to the invention. Therefore the published application also includes the revealed content of the related or added priority documents (copy of the pre-application), which has also been done in the aim of including characteristics of these documents in the claims of the present application.

What is claimed is:

1. An electrical plug-and-socket connection with a male plug that includes at least two contact pins each having a metallic core and an electrically conducting section, which contact pins are linked to a base body of a plug-in aperture which connects to a plug-in section of a female plug, and connection of the male and female plugs is accomplished by inserting the electrically conducting sections of the contact pins into contact apertures of the front side of the plug-in section of the female plug, and where a section of every contact pin that connects immediately to the base body of the plug-in aperture is circumferentially insulated by a collar that is connected by being of identical material with the base body of the plug-in aperture, characterized in that the collar has a frustum-shaped mantle surface and when plugged together is in uninterrupted circumferential contact with an edge section of the walling of the contact aperture of the female plug at least in some areas;

wherein the collar surrounds a section with reduced cross-section of the metallic core of the contact pin; and wherein the mantle surface of the collar changes over without irregularity to the mantle surface of the electrically conducting section of the contact pin.

2. An electrical plug-and-socket connection according to claim 1, wherein the outer edge of a plug-in aperture is in insulating contact with the mantle surface of the collar.

3. An electrical plug-and-socket connection according to claim 1, wherein devices that exert an axially connecting force actuate a section of the mantle surface of the collar against a section of the walling of the contact aperture.

4. An electrical plug-and-socket connection according to claim 1, wherein a angle of aperture of the collar in particular is less than 10 degrees.

5. An electrical plug-and-socket connection according to claim 1, wherein the electrically conducting section of the contact pin is encapsulated circumferentially by insulating material when the male and female plugs are joined together.

6. An electrical plug-and-socket connection according to claim 3, wherein the devices that exert axial force are in the form of a screw-in connection or utilize a spring force.

7. An electrical plug-and-socket connection according to claim 1, wherein the base body and collar are formed of a plastic material.

8. An electrical plug-and-socket connection with a male plug that includes at least two contact pins each having a metallic core and an electrically conducting section, which contact pins are linked to a base body formed of a plastic material of a plug-in aperture which connects to a plug-in section of a female plug, and connection of the male and female plugs is accomplished by inserting the electrically conducting sections of the contact pins into contact apertures of the front side of the plug-in section of the female plug, and where a section of every contact pin that connects immediately to the base body of the plug-in aperture is circumferentially insulated by a collar that is part of the base body of the plug-in aperture, characterized in that the collar has a frustum-shaped mantle surface and when plugged together is in uninterrupted circumferential contact with an edge section of the walling of the contact aperture of the female plug at least in some areas; and wherein the mantle surface of the collar changes over without irregularity to the mantle surface of the electrically conducting section of the contact pin.

9. An electrical plug-and-socket connection according to claim 8, wherein the collar surrounds a section with reduced cross-section of the metallic core of the contact pin.

10. An electrical plug-and-socket connection according to claim 8, wherein the outer edge of the plug-in aperture is in insulating contact with the mantle surface of the collar.

11. An electrical plug-and-socket connection according to claim 8, wherein devices that exert an axially connecting force actuate a section of the mantle surface of the collar against a section of the walling of the contact aperture.

12. An electrical plug-and-socket connection according to claim 8, wherein a angle of aperture of the collar in particular is less than 10 degrees.

13. An electrical plug-and-socket connection according to claim 8, wherein the electrically conducting section of the contact pin is encapsulated circumferentially by insulating material when the male and female plugs are joined together.

14. An electrical plug-and-socket connection according to claim 11, wherein the devices that exert axial force are in the form of a screw-in connection or utilize a spring force.

* * * * *